US006081183A

United States Patent [19]

Mading et al.

[11] Patent Number: 6,081,183

[45] Date of Patent: Jun. 27, 2000

[54] RESISTOR ADAPTED FOR USE IN FORCED VENTILATION DYNAMIC BRAKING APPLICATIONS

[75] Inventors: James E. Mading, Sussex; William R. Luy, Colgate; John S. Jackson, West Allis, all of Wis.

[73] Assignee: Eaton Corporation, Cleveland, Ohio

[21] Appl. No.: 09/066,637

[22] Filed: Apr. 24, 1998

[51] Int. Cl.[7] ..... H01C 10/14

[52] U.S. Cl. ..... 338/57; 338/284; 338/318; 338/319; 338/58; 338/280; 338/281

[58] Field of Search ..... 338/57, 279, 281, 338/284, 283, 315, 316, 317, 318, 319, 290, 53, 291, 280, 58; 411/104

[56] References Cited

U.S. PATENT DOCUMENTS

| | | | |
|---|---|---|---|
| 2,680,178 | 6/1954 | Kuhn et al. | 201/69 |
| 4,051,452 | 9/1977 | Luy | 338/51 |
| 4,146,868 | 3/1979 | Kirilloff et al. | 338/295 |
| 4,316,172 | 2/1982 | Luy | 338/280 |
| 4,359,710 | 11/1982 | Luy | 338/51 |
| 4,651,124 | 3/1987 | Kirilloff et al. | 338/280 |
| 4,651,125 | 3/1987 | Harkness | 338/295 |
| 5,049,851 | 9/1991 | Kirilloff et al. | 338/280 |
| 5,068,637 | 11/1991 | Bayer | 338/57 |
| 5,245,310 | 9/1993 | Kirilloff et al. | 338/319 |
| 5,281,944 | 1/1994 | Kirilloff et al. | 338/280 |
| 5,304,978 | 4/1994 | Cummins et al. | 338/280 |

FOREIGN PATENT DOCUMENTS

| | | | |
|---|---|---|---|
| 694040 | 7/1953 | United Kingdom | 411/104 |

*Primary Examiner*—Karl Easthom
*Attorney, Agent, or Firm*—L. G. Vande Zande

[57] ABSTRACT

A continuous ribbon resistor element having a plurality of conjunctive lengths alternately connected by reflexes is supported in a frame comprised of silicon bonded laminated mica. The ribbon elements are formed with a single, flat convolution center offset to one side of an original plane and lateral portions offset to an opposite side of the plane, joined to the center offset by transition portions such that the centroid for any transverse cross section lies on the original plane. The offsets originate at flat end portions near the reflexes and have maximum offset intermediate the ends. Metal members are received in openings of the laminated mica insulators to receive threaded fasteners when attaching an insulator in edge-wise relationship to another. Thermally conductive termination connections are brought outside the frame and airflow passageway to remove from the passageway the additional heat otherwise absorbed by the terminals.

22 Claims, 5 Drawing Sheets

FIG.6
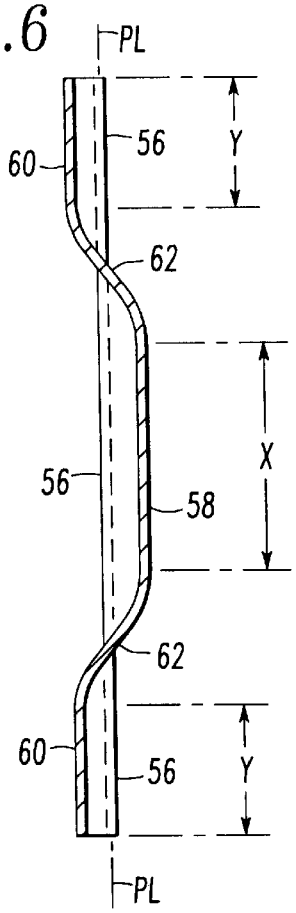
FIG.7
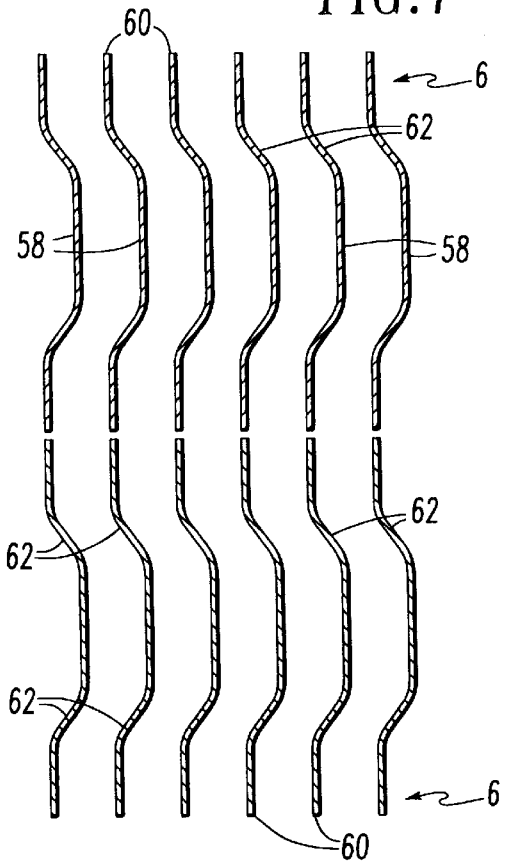
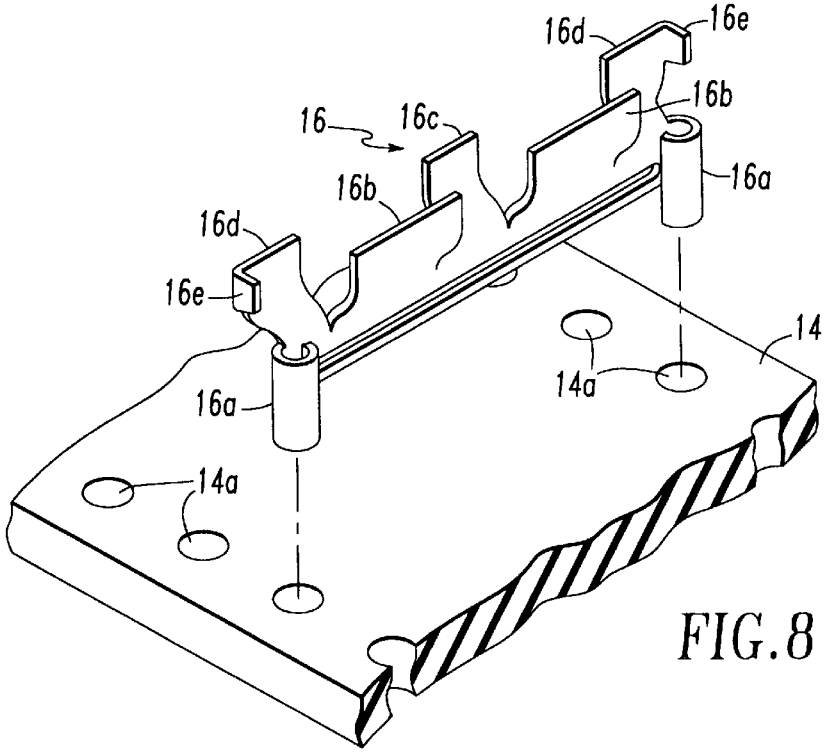
FIG.8

FIG. 9
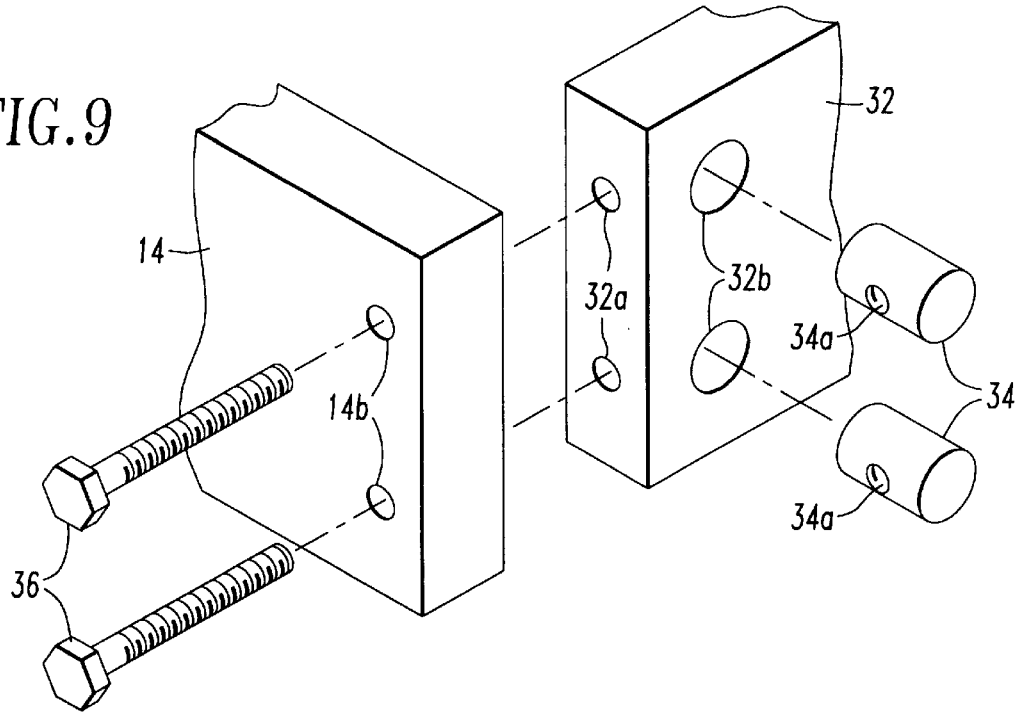
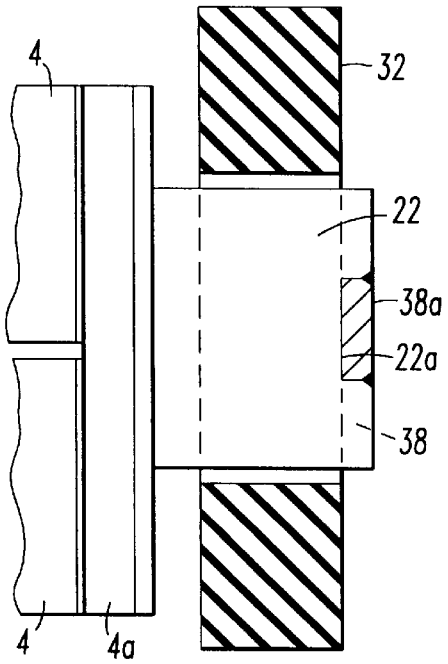
FIG. 10
FIG. 11
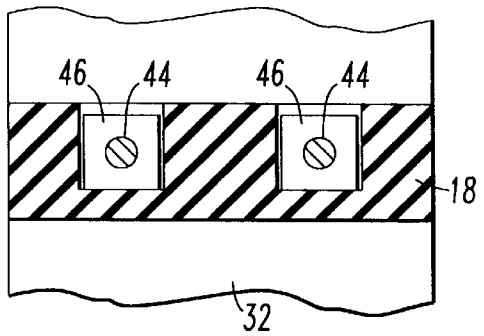

RESISTOR ADAPTED FOR USE IN FORCED VENTILATION DYNAMIC BRAKING APPLICATIONS

BACKGROUND OF THE INVENTION

This invention relates to resistors used in the dynamic braking function of electric traction motors such as those found in railroad locomotives, and in particular to an improved resistive ribbon element of the resistor which reduces the pressure drop of air passing through the resistor but maintains a predetermined column load strength for the ribbon element.

Resistors of the aforementioned type are well known. One example of such resistor is shown in Kuhn et al U.S. Pat. No. 2,680,178. The reflexed resistance ribbon of that patent has a transverse cross section comprising a triple convolution to provide the desired column load strength for the lengths between the reflexes and a resistance to airflow passing through the resistor for maximizing the heat transfer. Another example of a dynamic braking locomotive resistor is disclosed in Luy U.S. Pat. No. 4,316,172. As shown therein, reflexed resistance ribbons of the type shown in Kuhn et al U.S. Pat. No. 2,680,178 are supported between insulators within a frame by mounting brackets which attach to the insulators and support the reflexes of the resistance ribbon away from the surface of the insulator. This patent also shows a plurality of such reflexed resistance ribbons supported in immediately adjacent side-by-side juxtaposition by a common mounting bracket.

The resistor comprised of a single supporting frame structure is known as a resistor bank. In diesel electric locomotives and other vehicular traction applications, several resistor banks are commonly stacked in a serial arrangement in a forced ventilation system to dissipate the power generated by the drive motor in a braking situation. It has been found in some applications employing multiple resistor banks that the pressure drop across the combined resistor banks is too great, creating a detrimental resistance to airflow therethrough and thereby reducing the heat transfer cooling effect sought for the resistors. In extreme cases the pressure drop can be so great as to cause stalling of the air flow through the fan and resistor banks.

SUMMARY OF THE INVENTION

This invention provides a resistor for use in a forced ventilation dynamic braking application such as for a diesel electric traction motor or the like having an improved ribbon resistor element which has a simple, single convolution transverse cross section without sacrificing column load strength, thereby to reduce the resistance to air flowing across the ribbon and the pressure drop across the resistor in a forced ventilation system. The ribbon cross section design is effective for its desired purpose when used individually or in a side-by-side multiple ribbon element series airflow arrangement. This invention also provides further improvements to the resistor wherein mounting brackets for the resistor are improved to permit convenient attachment to various types of insulators and insulator materials. The invention also moves thermally conductive members such as terminals and terminal plates from the airflow passageway and locates them outside the resistor frame to reduce total heat otherwise acquired by these members and therefore retained within the airflow passageway.

The resistor of this invention, its features and advantages, will become more readily apparent when reading the following description and claims in conjunction with the appended drawings.

BRIEF DESCRIPTION OF THE DRAWINGS

FIG. 6 is a transverse cross section of the ribbon resistor element taken along the line 6—6 in FIG. 4;

FIG. 7 is a cross sectional view taken along the line 7—7 in FIG. 1 showing a pair of ribbon resistor elements arranged side-by-side in a series airflow relation;

FIG. 8 is a three dimensional illustration of a mounting bracket for the ribbon resistor elements and a fragment of an insulator of this invention;

FIG. 9 is an exploded three dimensional illustration of a pair of insulators used in the resistor of this invention showing an improved method of joining the insulators;

FIG. 10 is a cross sectional view taken along the line 10—10 in FIG. 1 showing a termination of the ribbon resistor elements of this invention, and FIG. 11 is a cross sectional view taken along the line 11—11 in FIG. 1 showing another method of joining the insulators.

DETAILED DESCRIPTION OF THE PREFERRED EMBODIMENTS

Figure 1:
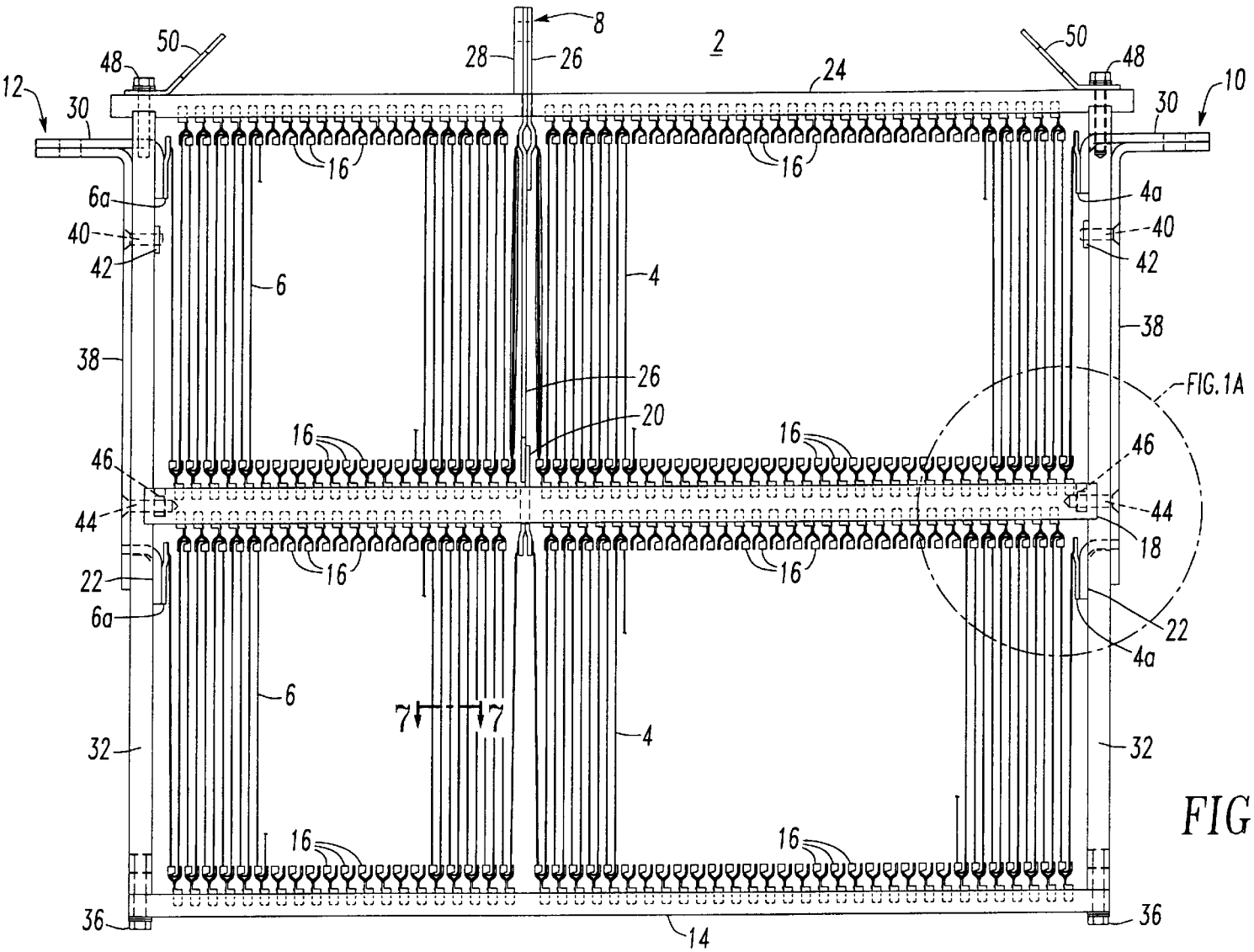
FIG. 1 is a front elevational view of a resistor constructed in accordance with this invention.

With particular reference to FIG. 1 of the drawings, the resistor 2 of this invention comprises multiple resistor elements 4 and 6 supported in a frame to establish a resistor grid in an airflow passageway defined by the frame. The resistor elements are preferably a serpentine formed ribbon of resistance material comprising a plurality of reflexes joined by substantially straight conjunctive lengths as taught in Kuhn et al U.S. Pat. No. 2,610,178. However, alternate types of resistor elements may be employed, such as multiple pieces alternately joined at their opposite ends by reflexes, welding, pressure connections or a combination thereof As shown in FIG. 1 resistor elements 4 are longer than resistor elements 6 by approximately a 2:1 ratio. The particular preferred embodiment illustrated in FIG. 1 has a first resistor element pair 4 and 6 at the top half of the insulating frame and a second resistor element pair 4 and 6 at the lower half of the insulator frame. The resistor elements 4 and 6 are connected together in series at a terminal assembly 8 which provides an intermediate tap for resistor 2. The first and second resistor element pairs are electrically connected in parallel through terminal assembly 8 and end terminal assemblies 10 and 12 as will be more fully described hereinafter. It will be appreciated that through use of various length resistance elements and appropriate terminations, the respective resistor elements may be selectively connected in various series or parallel arrangements having selected resistive values as determined by the specifications of a particular application for the resistor.

Referring to FIGS. 1 and 8, a bottom insulator 14 is provided with a plurality of aligned sets of round holes 14*a* (FIG. 8) arranged in two rows along the edges of the insulator. The insulators used for the frame of resistor 2 of this invention have a high heat resistance requirement. A suitable type of insulator used herein is a silicon bonded mica laminate which is manufactured in board-like members which are cut to size and require subsequent machining operations such as drilling to provide structural features such as the holes 14*a*. The mica insulator boards have good beam strength in the size and thickness used in this application and therefore permit the frame to be made entirely of insulator members. Other insulator members, such as molded insulators, may also be used.

Mounting brackets 16, as best shown in FIG. 8, are attached to the insulator 14 by inserting resilient depending pin portions 16*a* into respective sets of the holes 14*a*. Brackets 16 are very similar to those shown in Luy U.S. Pat. No. 4,316,172 having arcuately shaped upwardly directed arms 16*b*, 16*c* and 16*d* offset in opposite directions to provide a semicylindrical, upwardly open pocket between the arms. The ends of outer arms 16*d* are bent at right angles to the arm to provide closed ends 16*e* for the pockets whereby the pockets receive and retain the reflexes of one or more resistance ribbon elements 4 or 6. Depending tabs formed on the mounting bracket 16 are rolled into a partially closed cylindrical shape to form the cylindrical pins 16*a* as shown in the drawing. A complementary hole which may be round, square, hexagonal or other complementary shape can be readily formed in the insulator by many manufacturing processes, and in the case of insulator materials such as silicon bonded mica laminate, can be provided by drilling. The pins 16*a* are compressed upon insertion into the holes 14*a* to firmly hold the bracket 16 to the insulator 14. As is known from U.S. Pat. No. 4,316,172, the bracket is provided with a central body portion for spacing the supporting pocket above the surface of the insulator into the airflow passageway to provide adequate ventilation for the ribbon resistor element at the reflex thereof. Also, bracket 16 is made of a predetermined length to accommodate multiple resistor elements side-by-side, and in the preferred embodiment of this invention, the bracket 16 is made to accept two ribbon resistor elements side-by-side to provide a parallel ribbon configuration for each resistor bank. Other support means may be employed such as the pins disclosed in U.S. Pat. Nos. 4,051,452 and 4,359,710.

Referring again to FIG. 1, the lower reflexes of pairs of resistor elements 4 and 6 are supported in the open pockets of mounting brackets 16 attached to bottom insulator 14. A center insulator 18, somewhat thicker than bottom insulator 14, has aligned rows of holes similar to 14*a* formed on opposite surfaces thereof to provide corresponding sets of holes for receiving mounting brackets 16 therein. The center insulator 18 is positioned on top of the lower pairs of resistor elements 4 and 6 such that the upper reflexes thereof are received in the clips 16 attached to the bottom surface of center insulator 18. It will be seen that the left-hand ends of lower resistor elements 4 and the right-hand ends of lower resistor elements 6 are attached by welding or the like, to a terminal assembly 20 which extends upwardly through an opening in the center insulator 18. The opposite ends of each of the lower resistor elements 4 and 6 are connected, again by welding or the like, to respective terminal plates 4*a* and 6*a* which in turn are attached by welding or the like to right angle terminal brackets 22 which have legs extending outwardly away from the respective ribbon resistor elements.

An upper insulator 24 having rows of holes similar to 14*a* and a plurality of mounting brackets 16 attached thereto is used in conjunction with the upper surface of center insulator 18 to support upper resistor elements 4 and 6. Pairs of ribbon resistor elements 4 and 6 are mounted between the mounting brackets 16 attached to the upper side of center insulator 18 and the mounting brackets 16 of upper insulator 24. The left-hand ends of upper ribbon resistor elements 4 and the right-hand ends of upper ribbon resistor elements 6 are attached to a pair of welded plates 26, one of which is particularly elongated to extend to the terminal assembly 20 of the lower resistor elements and is welded thereto. The plates 26 extend through an opening in upper insulator 24 and have a terminal plate 28 welded thereto at the external portion thereof, thus establishing the intermediate tap terminal assembly 8. The opposite ends of the respective resistor elements are connected to respective terminal plates 4*a* and 6*a* which are in turn attached by welding or the like to right angle terminal brackets 30.

End plate insulators 32, also made of silicon bonded laminated mica, are attached to lower insulator 14, center insulator 18 and upper insulator 24 to provide an all-insulator support frame for the resistor 2 of this invention. However, the mica and certain other suitable insulating materials do not have particular tension strength for holding screws in an edge-wise direction. Accordingly, this invention contemplates a method of attachment for securing the support insulators together under compressive forces which has the securing fastener extending through an opening in a major flat surface of one insulator member and an aligned edge-wise directed hole in the other member to be threadably engaged in a metal element retained in an opening extending between major flat surfaces of the other insulator support member. As particularly shown in FIG. 9, lower insulator 14 is provided with holes 14*b* which extend through the insulator from the lower major flat surface to the upper major flat surface thereof. Corresponding aligned holes 32*a* are provided in the lower edge of end insulator 32 extending edge-wise into the insulator 32. Holes 32*a* intersect with holes 32*b* formed through the insulator 32 from the outer major flat surface to the inside major flat surface. Metal pins 34 having a radially directed threaded hole 34*a* are received in the holes 32*b* such that the hole 34*a* is rotated into alignment with the hole 32*a* to threadably receive machine screws 36, thereby clamping the insulator 32 against the surface of insulator 14.

Figure 2:
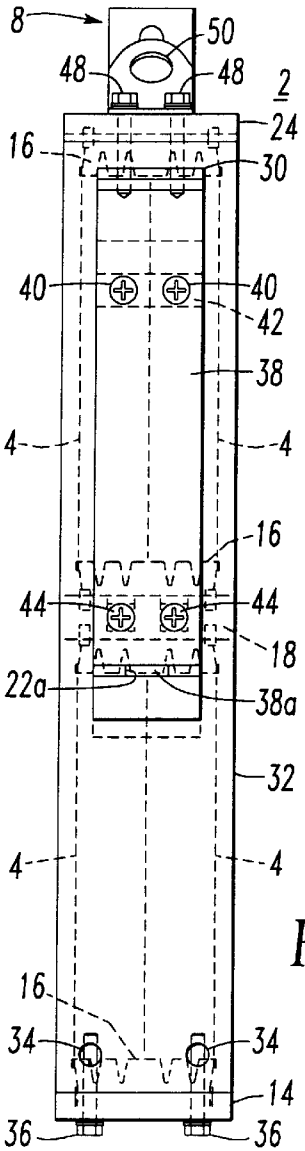
FIG. 2 is an end elevational view of the right-hand end of the resistor of FIG. 1.
Figure 1A:
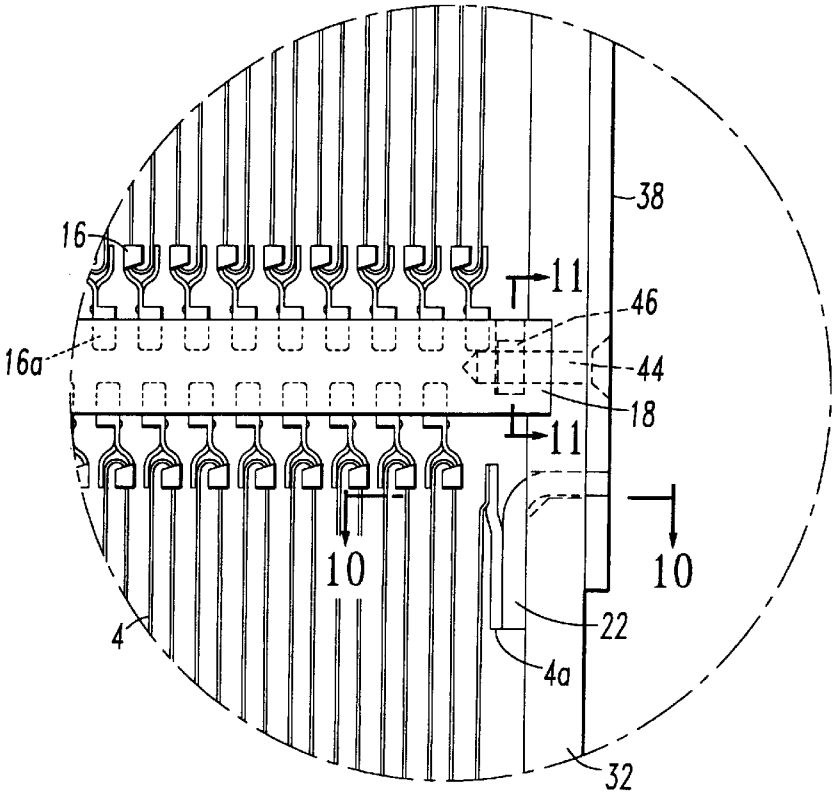
FIG. 1A is an enlarged elevation view taken within the circular line FIG. 1A in FIG. 1.

Insulators 32 are provided with rectangular slots therethrough for receiving the projecting legs of terminal brackets 22 and 30. A connecting angle plate 38 is disposed along the outer surface of each end insulator 32, the plate 38 having an outwardly directed leg which immediately underlies the projecting portion of terminal bracket 30. As seen in FIGS. 2 and 10, the free end of terminal bracket 22 is centrally notched at 22*a* and the outer edges of plate 38 are laterally notched to provide a central tongue 38*a* which is disposed within the notch 22*a*, thereby interlocking the plate 38 and terminal bracket 22. The members are further secured by welding at the juncture of notch 22*a* and central tongue 38*a*. Also, the abutting outwardly extending legs of plate 38 and terminal bracket 30 are welded to provide a unitary assembly. A first pair of machine screws 40 are positioned through corresponding holes in plate 38 and in end insulator 32 to threadably engage in a metal strap 42 at the inner surface of end insulator 32 to further support the terminal assembly to the end insulator. A second pair of machine screws 44 are inserted through holes in the plate 38 and in a major flat surface of end insulator 32 adjacent a mortised area of end insulator 32 to extend into aligned edge-wise extending holes in the center insulator 18. As seen in FIG. 11, center insulator 18 has a pair of rectangular slots open to the upper surface adjacent opposite ends thereof. Square nuts 46 are positioned in the slots for receiving the shank of machine screws 44 to clamp the conductor plate 38, end insulator 32 and center insulator 18 tightly together.

Upper insulator 24 is attached to the upper ends of end insulators 32 by machine screws 48. As seen in FIG. 1, the lower surface of upper insulator 24 is mortised at the appropriate locations to receive the upper ends of insulators 32. In keeping with the assembly concept to thread the screws into metal members, the terminal brackets 30 are provided with tapped holes to receive the machine screws 48, thereby clamping the upper insulator 24 to the end insulators 32. Plate-like eyelets 50 are also secured to the upper insulator 24 by the machine screws 48 for handling the resistor bank 2 during installation.

Figure 3:
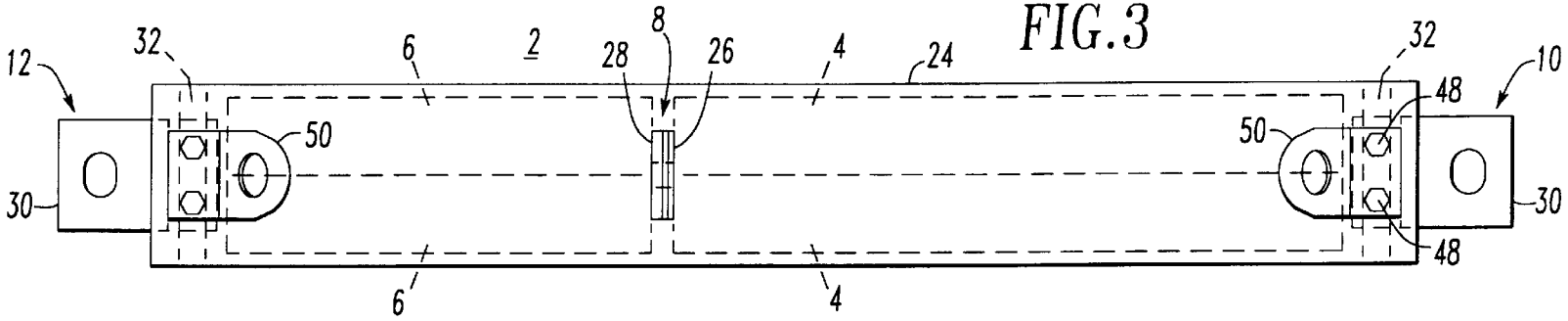
FIG. 3 is a top plan view of the resistor of FIG. 1.

The assembled insulators 14, 18, 24 and 32 define a window frame for the resistor grid comprising ribbon resistor elements 4 and 6. It will be noted from FIGS. 2 and 3 that the edges of the laminated mica insulators are flat and therefore the resistor banks can be stacked side-by-side in a series arrangement relative to the airflow in a forced ventilation system, the windows defining an airflow passageway therethrough. By making appropriate electrical connections, the significant amount of electrical energy generated by a motor under braking action can be dissipated through a group of resistors.

As noted earlier, it is necessary to provide structural formations in the conjunctive lengths of the resistive ribbon to provide columnar strength to that length to prevent buckling under thermal expansion and to give stability against vibration present in a moving vehicle such as a railroad locomotive. Such structural formations are also particularly shaped to provide a desired resistance to airflow over the surface of the ribbon to attain maximum cooling. However, when several resistor banks 2 are arranged or mounted in a serial airflow pattern, the pressure drop from the inlet to the outlet of the airflow passageway can increase to an amount which adversely effects the airflow, impeding it to a point where convection cooling or heat transfer is detrimentally reduced. Accordingly, this invention directs particular attention to the transverse cross sectional shape of the individual ribbon resistor element (4, 6) to reduce the pressure drop across the resistor bank 2, and thereby provide a reduced pressure drop across an installation involving several resistor banks.

Figure 4:
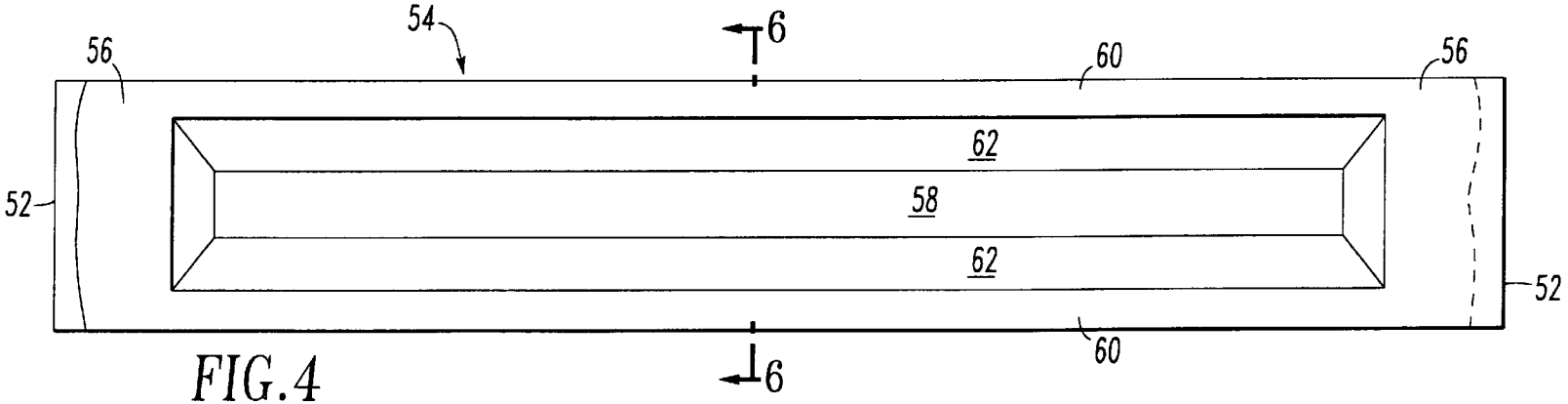
FIG. 4 is a plan view of a conjunctive length of the ribbon resistor element of this invention.
Figure 5:
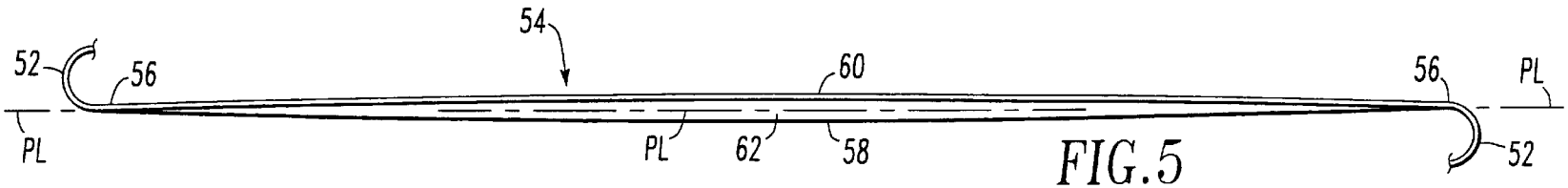
FIG. 5 is a side elevational view of the conjunctive length of ribbon resistor element shown in FIG. 4.

Referring particularly to FIGS. 4–7, the individual ribbon resistor element 4 or 6 is comprised of a standard resistance alloy material such as Ohmaloy™ resistance ribbon manufactured by Allegheny Ludlum Company. The ribbon is formed into a continuous reflexed element having reflexes 52 alternately connected by relatively straight conjunctive lengths 54 as seen in FIGS. 4 and 5. To reduce resistance to airflow over the surface of ribbon element 4, 6 and to maintain the necessary columnar strength in the longitudinal direction such as provided by the prior art triple convolution ribbon resistor, as shown in Kuhn et al U.S. Pat. No. 2,680,178, we have provided a particular single convolution to the individual ribbon element. As seen in the transverse cross section of FIG. 6, which is drawn to a larger scale, and FIGS. 4 and 5, the center portion 58 of a conjunctive length of the ribbon is offset to one side of the plane represented by dot-dash lines PL containing flat, coplanar end portions 56 which are adjacent the reflexes 52, and the lateral edge portions 60 of the conjunctive length are offset to an opposite side of the plane containing end portions 56. Preferably, the center portion 58 and the lateral portions 60 are offset by equal amounts on either side of the plane. The center portion 58 and lateral portions 60 each have flat transverse lengths X and Y which are joined by transition portions 62 which preferably are back-to-back reversed radii to form a smooth, tangential transition to the respective flat portions. The amount of offset of the center portion 58 and lateral portions 60, the transverse length of the respective flat portions X and Y, and the particular radii used to define the transition portions are all selected to cause a centroid of the respective cross section to lie in the original plane PL of the conjunctive length 54, i.e. the plane containing end portions 56. This consideration is important to providing the desired columnar strength to prevent buckling and vibration of the conjunctive length. As may be seen in FIG. 5, the offset portions may be tapered from an origin at the respective ends 56 to a maximum offset at the longitudinal mid-point of the conjunctive length 54, the taper being provided uniformly such that the centroid of each cross section lies on the plane PL of the conjunctive length 54. However, a preferred method of forming the offset portion is to create a large radiused curvature to the offset portions. The resulting ribbon has a single convolution which creates a desired turbulence but minimizes the same to reduce the amount of resistance to the airflow when the respective ribbon elements are installed such that the adjacent conjunctive lengths define narrow air passageways therethrough as shown in FIG. 7. As also seen in FIG. 7, it is preferred to provide two narrow ribbons side-by-side thereby providing a passageway having two convolutions as opposed to six convolutions provided by the prior art type of dual ribbon embodiment. This provides a significantly reduced pressure drop across the particular resistor bank provided by the resistor 2.

The foregoing has described a particular preferred embodiment and best mode of an improved resistor for use in forced ventilation dynamic braking systems which has improved structural features which permit the use of certain heat resistive electrical insulators as support members and has an improved ribbon resistance element for reducing the pressure drop of airflow across the surface of the element. Although the invention is described in terms of the preferred construction, it is to be understood that it is susceptible of various modifications and alternative embodiments without departing from the scope of the appended claims.

What is claimed is:

1. A ribbon type grid resistor for forced ventilation convective heat transfer applications, said resistor comprising:

a ribbon of resistance material having reflexes and conjunctive lengths between said reflexes, each of said conjunctive lengths having coplanar opposite end portions at junctures with respective said reflexes, said conjunctive lengths each having a transverse cross section having a central portion offset in a first direction and lateral edge portions offset in a second direction opposite said first direction such that a centroid of said cross section lies in a plane containing said coplanar opposite end portions, said offset central and lateral edge portions tapering from said end portions to a maximum offset at a longitudinal midpoint of said conjunctive length.

2. The ribbon type grid resistor defined in claim 1 wherein said central portion comprises a flat transversely extending portion from one said end portion to an opposite said end portion, said central portion being joined with said offset lateral edge portions by respective transition portions.

3. The ribbon type grid resistor defined in claim 2 wherein said centroid of each transverse cross section between said longitudinal midpoint and respective said coplanar end portions is uniformly in a plane containing said coplanar end portions.

4. A resistor for use in a forced ventilation convective heat transfer application, said resistor comprising:

a pair of spaced apart insulators an electrical resistor grid supported between said insulators, said grid comprising multiple spans of resistive ribbon electrically connected in series, said spans extending between said spaced apart insulators, each said span comprising an elongated ribbon having co-planar opposite end portions and a transverse cross section comprising a central portion offset in a first direction and lateral edge portions offset in a second direction opposite said first direction such that a centroid of said cross section lies in a plane containing said end portions, said offset central and lateral edge portions increasing from origins at said end portions to a maximum offset at a longitudinal midpoint of said span.

5. The resistor defined in claim 4 wherein said spans are disposed in close face-to-face relationship, adjacent spans forming a transverse airflow path therebetween, said offset central portion and said offset lateral edge portions comprising a single convolution over a transverse dimension of each said span.

6. The resistor defined in claim 4, wherein said central portion comprises a flat transverse portion from one said end portion to an opposite said end portion, said flat transverse portion being joined to said offset lateral edge portions by respective transition portions.

7. The resistor defined in claim 4, wherein said offset lateral edge portions comprise flat portions parallel to said flat transverse central portion.

8. The resistor defined in claim 4 comprising reflexes integrally formed at said end portions, said reflexes connecting said spans electrically in series.

9. The resistor defined in claim 4 wherein said multiple spans of resistive ribbon are electrically connected in series by reflexes integrally formed between said end portions of adjacent ones of said spans at respective alternate opposite ends, thereby to provide a serpentine ribbon resistor.

10. The resistor defined in claim 9 wherein said resistor grid is supported between said spaced apart insulators by brackets attached to said insulators and having means for receiving and positioning said reflexes, said brackets having depending compressible resilient pins, and said insulators having a plurality of holes arranged in sets for receiving said compressible resilient pins of respective said brackets, said pins being compressed in said holes for firmly securing said brackets to said insulators.

11. The resistor defined in claim 10 wherein said brackets are sheet metal members and said depending compressible resilient pins comprise portions of said bracket rolled into a partial cylindrical shape open along an edge extending parallel to an axis of said cylindrical shape.

12. The resistor defined in claim 1 comprising a pair of end insulators connected to said pair of spaced apart insulators, said resistor grid comprising a terminal attached to said resistive ribbon and extending through an opening in an insulator of a respective one of said end or spaced apart insulators to be disposed outside said respective one of said end or spaced apart insulators out of airflow through said resistor grid.

13. The resistor defined in claim 1 comprising a pair of end insulators connected to said pair of spaced apart insulators, said resistor grid comprising terminals attached to said resistor ribbon, each said terminal extending through an opening in a respective insulator of one of said end or spaced apart insulators to be disposed outside said respective one of said end or spaced apart insulators out of airflow through said resistor grid.

14. A resistor adapted for use in a forced ventilation convective heat transfer application comprising:

a support frame having an opening therethrough defining an airflow passageway;

at least one resistor element disposed in said opening;

mounting means on said support frame supporting said at least one resistor element in said opening as a grid in said airflow passageway; and electrical terminals attached to said at least one resistor element for connection to an external power source;

wherein said at least one resistor element comprises:

a ribbon of resistance material having reflexes and conjunctive lengths between said reflexes, said conjunctive lengths each comprising:

flat end portions at junctures with respective said reflexes at opposite ends of a respective said conjunctive length, said end portions being co-planar and defining a base plane for said conjunctive length;

a transverse cross section having i) a central portion offset to one side of said base plane, and ii) lateral edge portions on each side of said central portion offset to an opposite side of said base plane, such that a centroid of said cross section is disposed in said base plane, said offset central portion and lateral edge portions tapering from origins at said flat end portions to a maximum offset at a longitudinal midpoint of said conjunctive length.

15. The resistor defined in claim 14 wherein said resistor element central portion and lateral edge portions each comprise flat transversely directed parallel segments, said central and respective lateral edge portions being joined by transition portions.

16. The resistor defined in claim 15 wherein proportions of said transversely directed segments are selected to cause the centroid for the cross section to be disposed in said base plane.

17. The resistor defined in claim 15 wherein adjacent ones of said conjunctive lengths of said resistor element are disposed in close face-to-face relationship within said opening forming a transverse airflow path therebetween, each conjunctive length comprising a single convolution between opposite outermost edges of said resistor element.

18. The resistor defined in claim 17 wherein said at least one resistor element comprises a pair of identical resistor elements mounted in said frame in transversely aligned relationship along said airflow passageway, adjacent conjunctive lengths of each said resistor element forming a transverse airflow path therebetween, each path comprising a single convolution, and said airflow paths of each resistor element being serially aligned along said airflow passageway.

19. The resistor defined in claim 18 wherein said electrical terminals of said resistor elements are directed through said frame outside said frame out of said airflow passageway through said frame.

20. The resistor defined in claim 19 wherein an aligned pair of resistor elements are commonly connected to respective singular said electrical terminals, thereby providing two resistor elements electrically connected in parallel within said support frame.

21. The resistor defined in claim 14 wherein said frame comprises insulators disposed on opposite sides of said opening and said mounting means comprises brackets attached to said insulators and having means for receiving and positioning said reflexes, said insulators comprising a plurality of sets of holes, said brackets comprising depending resiliently compressible pins adapted to be received in a respective said set of holes in said insulator, said bracket being attached to said insulator by forcing said pins into said holes.

22. The resistor defined in claim 21 wherein said brackets comprise sheet metal members and said depending pins comprise integral depending tabs on said bracket rolled into a partially closed cylindrical shape.

* * * * *